US005133504A

United States Patent [19]

Smith et al.

[11] Patent Number: 5,133,504

[45] Date of Patent: Jul. 28, 1992

[54] THROUGHPUT EFFICIENCY ENHANCEMENT OF FLUIDIZED BED JET MILL

[75] Inventors: Lewis S. Smith, Fairport; Henry T. Mastalski, Webster, both of N.Y.

[73] Assignee: Xerox Corporation, Stamford, Conn.

[21] Appl. No.: 618,732

[22] Filed: Nov. 27, 1990

[51] Int. Cl.[5] ..... B02C 19/06

[52] U.S. Cl. ..... 241/5; 241/40

[58] Field of Search ..... 241/5, 39, 40

[56] References Cited

U.S. PATENT DOCUMENTS

| | | | |
|---|---|---|---|
| 2,874,095 | 2/1959 | Boisture et al. | 241/40 X |
| 3,482,786 | 12/1969 | Hogg | 241/40 X |
| 3,565,348 | 2/1971 | Dickerson et al. | 241/5 |
| 3,876,156 | 4/1975 | Muschelknautz et al. | 241/40 X |
| 4,059,231 | 11/1977 | Neu | 241/5 |
| 4,089,472 | 5/1978 | Siegel et al. | 241/5 |
| 4,244,528 | 1/1981 | Vlnaty | 241/5 |
| 4,280,664 | 7/1981 | Jackson et al. | 241/39 |
| 4,504,017 | 3/1985 | Andrews | 241/40 |
| 4,935,326 | 6/1990 | Creature et al. | 430/108 |
| 4,937,166 | 6/1990 | Creatura et al. | 430/108 |

*Primary Examiner*—Mark Rosenbaum
*Assistant Examiner*—S. Thomas Hughes
*Attorney, Agent, or Firm*—Kenyon & Kenyon

[57] ABSTRACT

A fluidized bed jet mill has a grinding chamber with a peripheral wall, a base, and a central axis. An impact target is mounted within the grinding chamber and centered on the chamber's central axis. Multiple sources of high velocity gas are mounted in the peripheral wall of the grinding chamber, are arrayed symmetrically about the central axis, and are oriented to direct high velocity gas along an axis intersecting the center of the impact target. In another embodiment, a fluidized bed jet mill has a grinding chamber with a peripheral wall, a base, and a central axis. Multiple sources of high velocity gas are mounted in the peripheral wall of the grinding chamber, are arrayed symmetrically about the central axis, and are oriented to direct high velocity gas along an axis intersecting the central axis of the grinding chamber. Each of the gas sources has a nozzle holder, a nozzle mounted in one end of the holder oriented toward the grinding region, and an annular accelerator tube mounted concentrically about said nozzle holder. The end of the accelerator tube closer to the nozzle is larger in diameter than the nozzle holder and the opposite end of the accelerator tube. The accelerator tube and the nozzle holder define between them an annular opening through which particulate material in the grinding chamber can enter and be entrained with the flow of gas from the nozzle and accelerated within the accelerator tube to be discharged toward the central axis. These embodiments can be combined for further efficiency enhancement.

23 Claims, 7 Drawing Sheets

THROUGHPUT EFFICIENCY ENHANCEMENT OF FLUIDIZED BED JET MILL

BACKGROUND OF THE INVENTION

Fluid energy, or jet, mills are size reduction machines in which particles to be ground (feed particles) are accelerated in a stream of gas (compressed air or steam) and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotor's rotation. The size of the particles passed varies with the rotor's speed; the faster the rotor, the smaller the particles. These particles become the mill's product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of pressurized gas supplied to the mill. One mechanism proposed for enhancing grinding efficiency is the projection of particles against a plurality of fixed, planar surfaces, fracturing the particles upon impact with the surfaces. An example of this approach is U.S. Pat. No. 4,059,231 to Neu, in which a plurality of impact bars with rectangular cross sections are disposed in parallel rows within a duct, perpendicular to the direction of flow through the duct. The particles entrained in the air stream passing through the duct are fractured as they strike the impact bars. U.S. Pat. No. 4,089,472 to Siegel, et al. discloses an impact target formed of a plurality of planar impact plates of graduated sizes connected in spaced relation with central apertures through which a particle stream can flow to reach successive plates. The impact target is interposed between two opposing fluid particle streams, such as in the grinding chamber of a Majac mill.

Although fluidized bed jet mills can be used to grind a variety of particles, they are particularly suited to grinding toner materials used in electrostatographic reproducing processes. These toner materials can be used to form either two component developers (typically with a coarser powder of coated magnetic carrier material to provide charging and transport for the toner) or single component developers (in which the toner itself has sufficient magnetic and charging properties that carrier particles are not required). The single component toners are composed of resin and a pigment such as commercially available MAPICO Black or BL 220 magnetite. Compositions for two component developers are disclosed in U.S. Pat. Nos. 4,935,326 and 4,937,166 to Creatura, et al.

The toners are typically melt compounded into sheets or pellets and processed in a hammer mill to a mean particle size of between of 400 to 800 μm. They are then ground in the fluid energy mill to a mean particle size of between 3 and 30 μm. Such toners have a relatively low density, with a specific gravity of approximately 1.7 for single component and 1.1 for two component toner. They also have a low glass transition temperature, typically less than 70° C. The toner particles will tend to deform and agglomerate if the temperature of the grinding chamber exceeds the glass transition temperature.

Although the fluidized bed mill is satisfactory, it could be enhanced to provide a significant improvement in grinding efficiency. The Siegel and Neu disclosures are directed to mills in which the particles are mixed in the gas jet flows outside the grinding chamber and as such are not suited for use in a fluidized bed mill. Furthermore, where flat surfaces are employed as targets, complex structural elements may be required to insure maximum exposure to the moving particles. Thus, there is a need for a mechanism to enhance the grinding efficiency of a fluidized bed jet mill.

SUMMARY OF THE INVENTION

The invention described herein overcomes deficiencies described in connection with prior art devices described above. For this purpose a fluidized bed jet mill is used that has a grinding chamber with a peripheral wall, a base, and a central axis. An impact target is mounted within the grinding chamber and centered on the chamber's central axis. Multiple sources of high velocity gas are mounted in the peripheral wall of the grinding chamber, are arrayed symmetrically about the central axis, and are oriented to direct high velocity gas along an axis intersecting the center of the target.

In another embodiment, a fluidized bed jet mill is used that has a grinding chamber with a peripheral wall, a base, and a central axis. Multiple sources of high velocity gas are mounted in the peripheral wall of the grinding chamber, are arrayed symmetrically about the central axis, and are oriented to direct high velocity gas along an axis intersecting the central axis of the grinding chamber. Each of the gas sources has a nozzle holder, a nozzle mounted in one end of the holder oriented toward the central axis, and an annular accelerator tube mounted concentrically about said nozzle holder. The end of the accelerator tube closer to the nozzle is larger in diameter than the nozzle holder and the opposite end of the accelerator tube. The accelerator tube and the nozzle holder define between them an annular opening through which fluidized particulate material in the grinding chamber can enter and be entrained with the flow of gas from the nozzle and efficiently accelerated within the accelerator tube to be discharged toward the central axis.

These embodiments, that is the impact target and the accelerator tube, can be combined for further efficiency enhancement.

A method is also disclosed for grinding particles of electrostatographic developer material in the enhanced fluidized bed jet mill.

The above discussion is a summary of certain deficiencies in the prior art and features of the invention described herein. Other features and advantages of the invention will be apparent to those skilled in the art from the following detailed description of the invention.

DETAILED DESCRIPTION

Figure 1A:
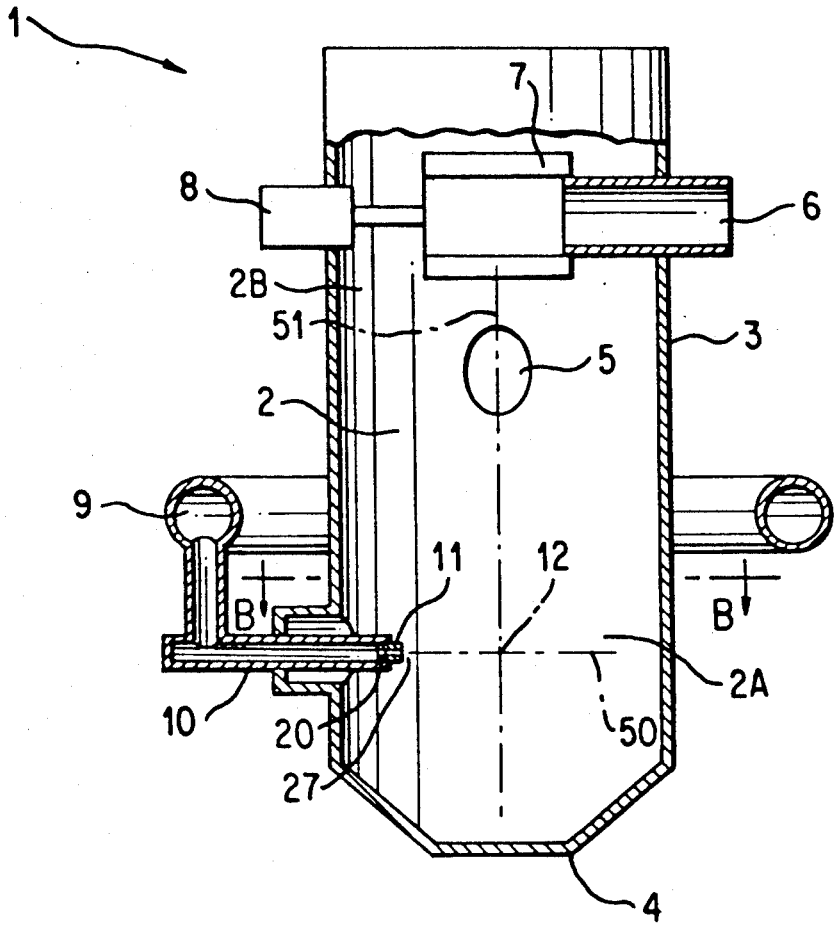
FIG. 1A PRIOR ART
FIGS. 1A and 1B are schematic representations in cross section, in elevation and plan, respectively, of a prior art fluidized bed jet mill with no central impact target or accelerator tubes.
Figure 1B:
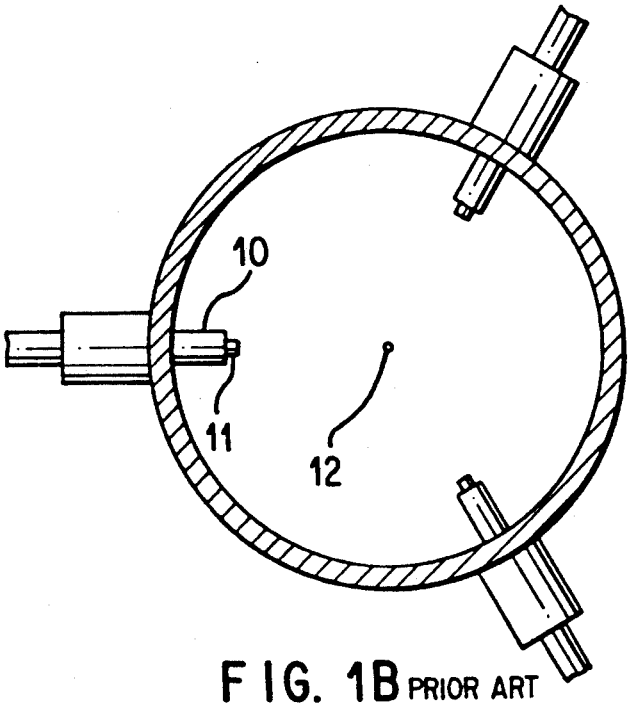
FIG. 1B PRIOR ART

A conventional single-chamber fluidized bed jet mill 1 is illustrated in FIGS. 1A and 1B. The mill has a grinding chamber 2 bounded by a peripheral wall 3 and a base 4. The grinding chamber 2 has a grinding zone 2A and a classification zone 2B. Product to be ground is introduced into the grinding chamber via feed inlet 5. Ground particles are lifted to the classification zone 2B and are classified by classifier rotor 7, driven by classifier drive motor 8. Ground product is discharged from the grinding chamber via product outlet 6. A source of compressed gas, such as steam or air, supplies the gas to compressed gas nozzle holders 10 through compressed gas manifold 9. Nozzles 11, mounted in the nozzle holders, inject the compressed gas into grinding zone 2A. The nozzles 11, spaced equally around the periphery of grinding zone 2A, are arranged in a plane 50 generally perpendicular to the central axis 51 of the grinding chamber. The nozzle's axes intersect at a point 12 common with the plane 50 and the central axis 51. As is well known in the art, a fluidized bed of feed material is formed during operation of the mill in the grinding zone 2A.

The nozzles are formed with a minimum internal diameter 20. Conventionally, the relationship between the diameter of the grinding chamber and the nozzle internal diameter is such that the distance from the radially inner end 27 of each nozzle to the intersection point of the nozzle axes is approximately 20 times the nozzle internal diameter.

Figure 2B:
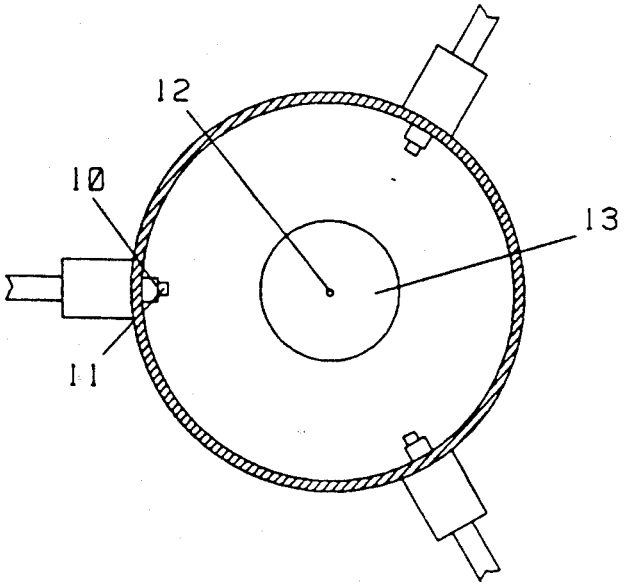
FIGS. 2A and 2B are schematic representations in cross section, in elevation and plan, respectively, of a fluidized bed jet mill with a spherical central impact target constructed according to the principles of the invention.
Figure 2A:
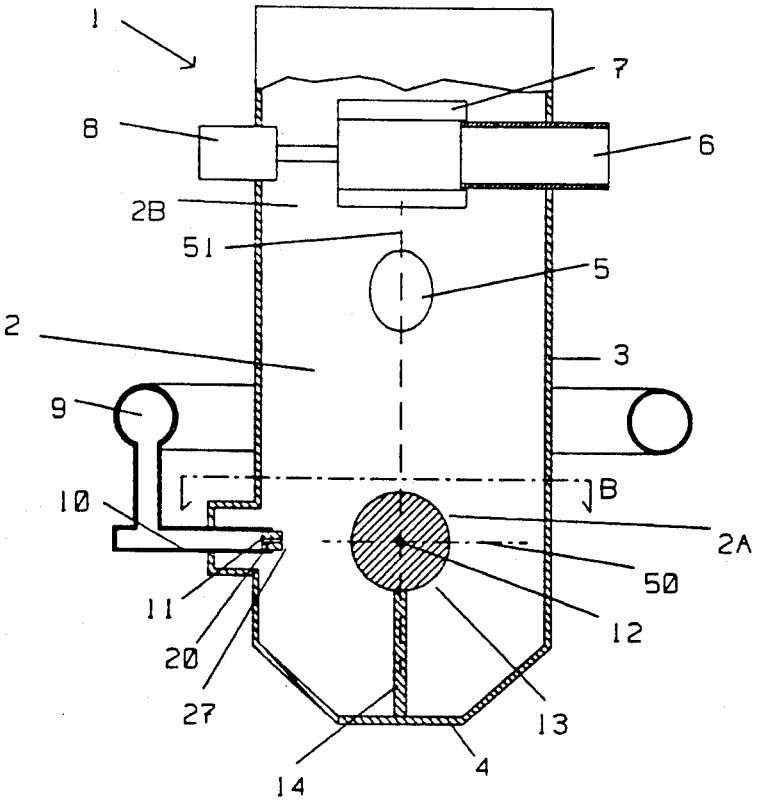

An embodiment of the invention is shown in FIGS. 2A and 2B. In this embodiment, a spherical impact target 13 is mounted within the grinding chamber, centered on the nozzle intersection point 12. The nozzles are mounted in the peripheral wall such that the distance from the radially inner end of the nozzle to the nearest surface of the target is approximately equal to the distance from the nozzle to the nozzle intersection point in the conventional mill with no target. This distance is therefore approximately 20 times the internal diameter 27 of the compressed gas nozzle 11. However, this distance may be varied substantially.

Figure 3:
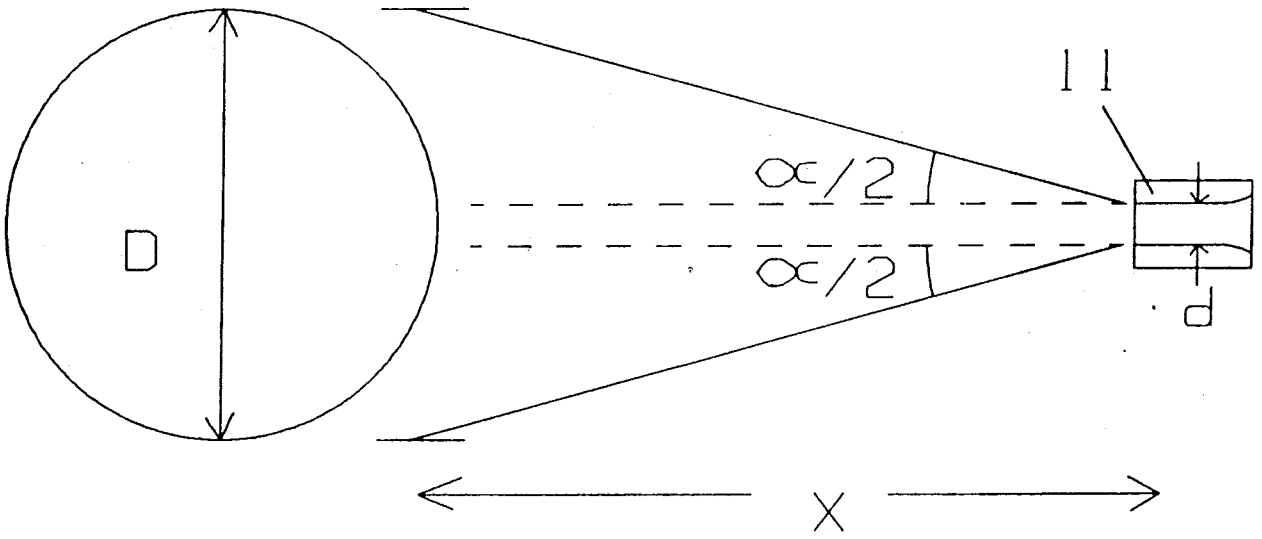
FIG. 3 is a schematic illustration of the relative geometry of the central target of the present invention and the discharge jet of compressed gas from the compressed gas nozzle of a fluidized bed jet mill.

The impact target has a diameter of between 1 and 25 times the nozzle internal diameter. In a preferred embodiment, the diameter of the target corresponds approximately to the diameter of the jet of compressed gas discharged from the nozzle at the target. For example, as illustrated in FIG. 3, if the included angle $\alpha$ of the discharge jet is 8°, and distance X from the nozzle to the surface of the target is 20 times the minimum nozzle internal diameter d, the diameter D of the target is roughly $(1+2\cdot X\cdot\tan(\alpha/2))\cdot d$, or 3.8 times the nozzle diameter.

The impact target is formed of a hard, rigid material, such as steel. The material should be sufficiently rigid to not flex or vibrate during operation of the mill. The target is subject to noticeable abrasion by the material being ground after extended usage. For example, the iron oxide (a magnetite) in single component toners is more abrasive than many other toner materials. The target should therefore have a surface sufficiently hard to resist abrasion over a desired operating life of the target. The surface may be coated with an abrasion resistant material, such as tungsten carbide, silicon carbide, amorphous carbon, diamond, or suitable ceramic material, or may be formed entirely of such materials.

The impact target is mounted within the grinding chamber at one end of a target mount 14. The target mount is also formed of a hard, rigid material, such as steel, and is fixed at its lower end to the base of the grinding chamber by a conventional technique such as welding or threaded attachment. It should be sufficiently rigid to prevent the target from moving or vibrating during operation and, like the target, should have an abrasionresistant surface. In the illustrated embodiment, the target mount is a one inch diameter threaded steel rod.

Figure 4B:
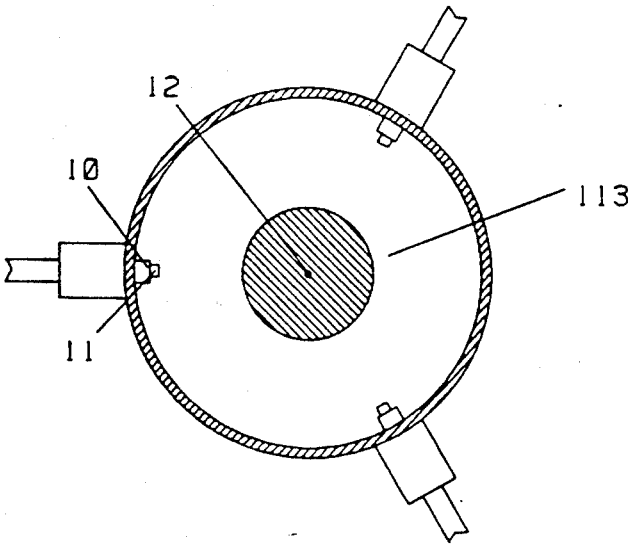
FIGS. 4A and 4B are schematic representations in cross section, in elevation and plan, respectively, of a fluidized bed jet mill with a cylindrical central impact target constructed according to the principles of the invention.
Figure 4A:
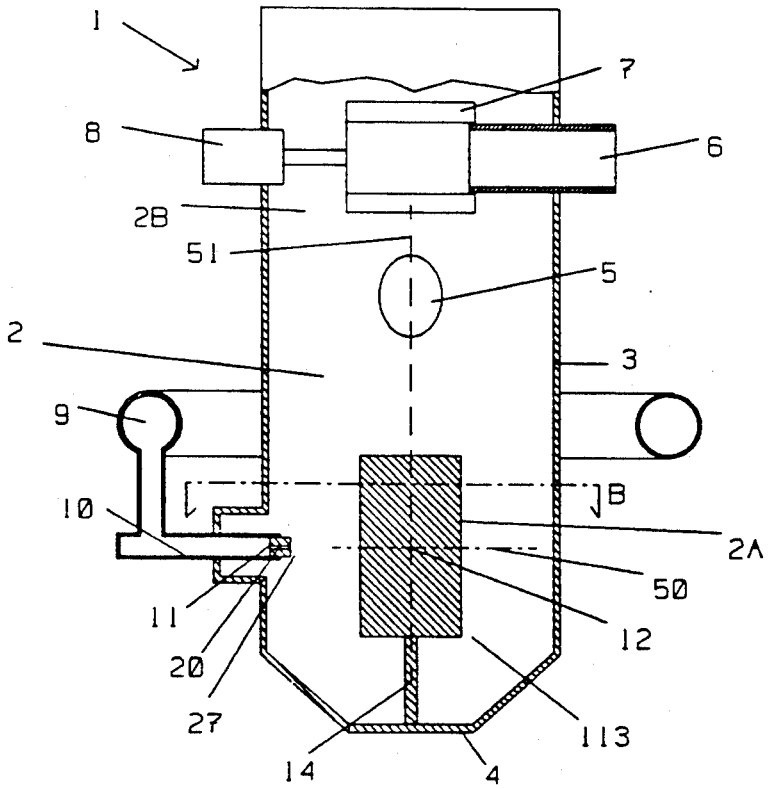
Figure 5B:
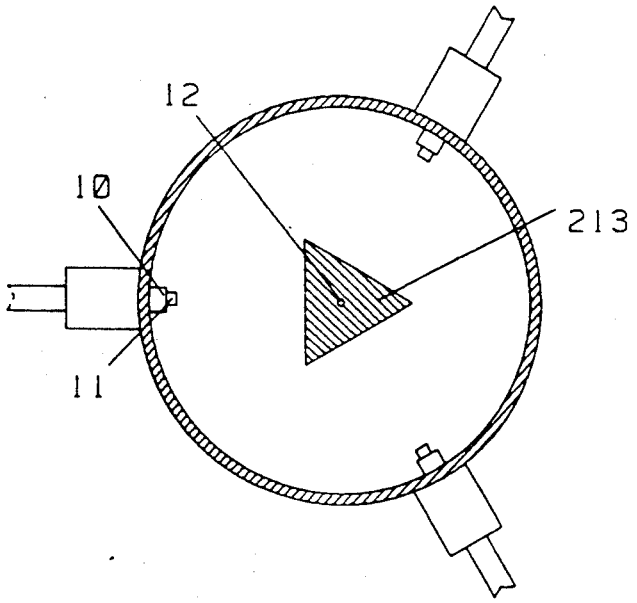
FIGS. 5A and 5B are schematic representations in cross section, in elevation and plan, respectively, of a fluidized bed jet mill with a planar central impact target constructed according to the principles of the invention.
Figure 5A:
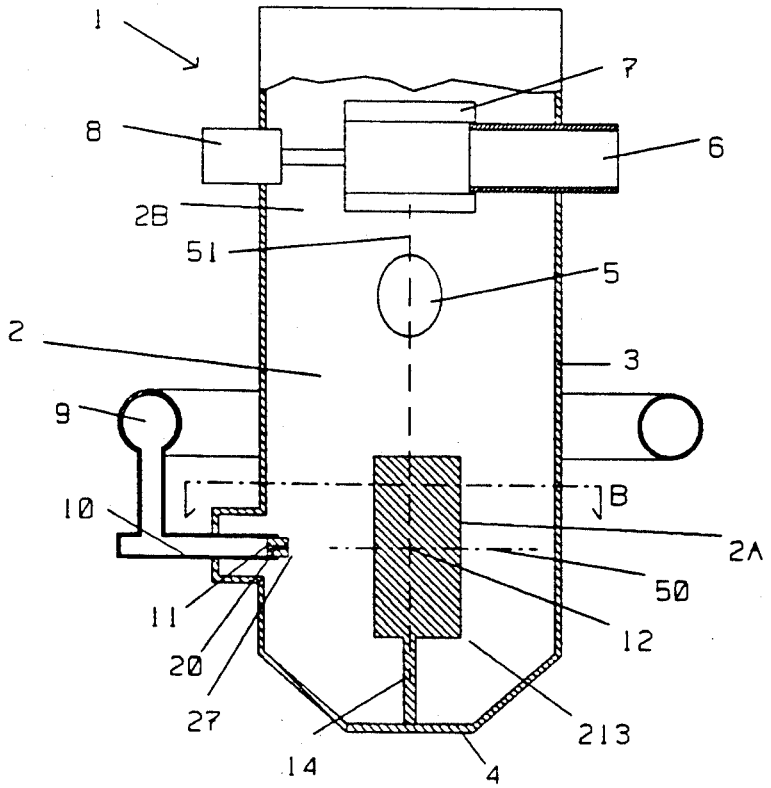

As illustrated in FIGS. 4A and 4B, the impact target may also be cylindrical. The cylindrical target 113 is mounted within the chamber concentric with the central axis of the chamber and centered on nozzle intersection point 12. In a preferred embodiment, the diameter of the cylinder equals the diameter of the expanded jet, as described above. The length of the target is approximately at least equal to its diameter. As shown in FIGS. 5A and 5B, the impact target may also have planar surfaces. Impact target 213 is also mounted within the grinding chamber along the central axis of the chamber. It is formed with a number of vertical planar faces equal to the number of nozzles and oriented so that the faces are aligned with the nozzles. The planar faces may be parallel to the chamber central axis, and thus perpendicular to the nozzle axis, as illustrated, or may be inclined relative to the nozzle axis. If the planar faces are inclined, they remain aligned with the nozzles, so that the surface normal of the planar face lies in a plane defined by the chamber central axis and the axis of the corresponding nozzle. In a preferred embodiment, the width and height of the planar faces equals the diameter of the expanded jet, as described above.

Provision may also be made for controlling the temperature of the target surface. The target becomes heated during operation by the energy of the grinding and the mechanical energy of the classifier rotor. If heated above the glass transition temperature of the feed material, which for toners is low, the particles can agglomerate and deform rather than fracture. Keeping the surface of the impact target cool can maintain the desired fracturing conditions. Conversely, in some circumstances it can be desirable to elevate the target temperature to achieve certain surface treatment or finish on the particles. Temperature control can be achieved by circulating fluid through internal passages formed in the target and the target mount and regulating the temperature of the fluid.

Tests conducted with the impact targets described above have demonstrated that the targets enhance the throughput efficiency of the fluidized bed jet mill. An Alpine AFG 400 Type II mill similar to the disclosed embodiments was used in the testing. The mill has a grinding chamber with an internal diameter of approximately 400 mm and a height of approximately 750 mm. It is fitted with three equally-spaced nozzles, each with an 8 mm internal diameter. The compressed gas is dry air supplied by a compressor at a constant pressure of 6 Bar, gauge, at a nominal airflow of 800 $m^3$/hr. The compressed air is intercooled to a stagnation temperature of 20° to 30° C. before it enters the compressed air manifold. The mill is fitted with the standard mechanical classifier for the AFG 400 mill, which has a 200 mm diameter rotor.

The mill was tested in its standard configuration, without an impact target, and with a spherical target and two planar targets. The spherical target was 100 mm in diameter. It was tested with the nozzles set at two distances, 160 mm and 200 mm, from the surface of the target. The planar targets had a triangular cross section, with each face having a width of 100 mm, and had a length of 300 mm. One planar target had faces parallel to the central axis. The other had faces each of whose surface normal was inclined at 15° below the plane of the nozzle axes. Both planar targets were tested with the nozzles at 160 mm from the target surface. All of the targets were attached to target mounts formed of one inch diameter threaded rod. Both the targets and the mounts were formed of solid tool steel.

The feed material was an single component toner composed of approximately equal proportions of commercially available BL 220 magnetite and a binder resin of styrene n-butyl acrylate having a broadly distributed molecular weight centered about 60,000. The specific gravity of the toner is approximately 1.7, and it has a glass transition temperature of 65° C. The toner was ground from an initial mean diameter of approximately 700 μm to a final mean diameter of approximately 11 μm.

Table I below compares the test results for the various tested configurations.

| Test Configuration | Throughput (kg/hr) | Mean Particle Size (μm) |
|---|---|---|
| Baseline - no target | 48.9 | 11.0 |
| Spherical target at 160 mm | 64.5 | 10.9 |
| Spherical target at 200 mm | 64.5 | 11.1 |
| Planar target (parallel) at 160 mm | 57.0 | 10.8 |
| Planar target (inclined) at 160 mm | 56.4 | 10.8 |

These data indicate that the spherical target provides the greatest increase in throughput. The planar targets provide some improvement, but significantly less than the spherical target.

Another aspect of the present invention that enhances the throughput efficiency of a fluidized bed jet mill and can be used either alone or in combination with the central impact target aspect of the invention disclosed above is the accelerator tube.

Figure 6:
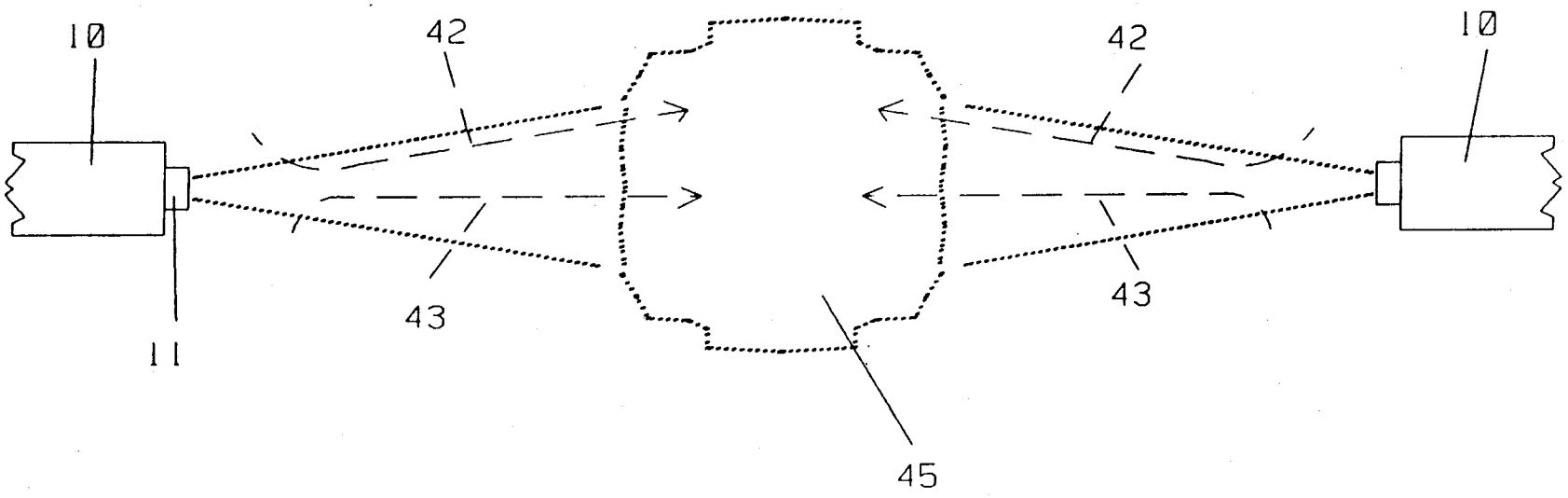
FIG. 6 is a schematic representation of the fluid flow in the grinding zone of a conventional fluidized bed jet mill.

In the conventional fluidized bed mill shown in FIGS. 1A and 1B, the particles of feed material circulate in the fluidized bed and are fractured by impact with each other primarily in the grinding zone 2A. As shown schematically and in more detail in FIG. 6, particles that enter the discharge jet of the nozzle are accelerated in the direction of the jet into a grinding region 45 where they collide with other particles accelerated by the other jets and fracture. The efficiency of a collision between two particles is related to the magnitude and relative direction of the velocity vectors of the particles. The efficiency is maximum when the velocity vectors are directly opposed, with the particles colliding head on, and increases with increasing magnitude of velocity.

The discharge jet of compressed air from the nozzles 11 expands in a generally conical fashion, as described above. Particles accelerated by the outer portion of the jet, thus following a path such as 42 in FIG. 6, therefore have a velocity component perpendicular to the axis of the nozzle and jet and, as compared to a particle accelerated in the center of the jet and thus following a path such as 43, will have a relatively lower velocity component parallel to the axis of the nozzle. Such particles will therefore not be fractured as efficiently as those particles that are accelerated in the center of the jet and enter the grinding zone along the plane of the nozzle axes. The efficiency of the grinder can be enhanced by accelerating the particles into the grinding zone with velocity vectors more closely aligned with the axes of the nozzles.

Figure 7:
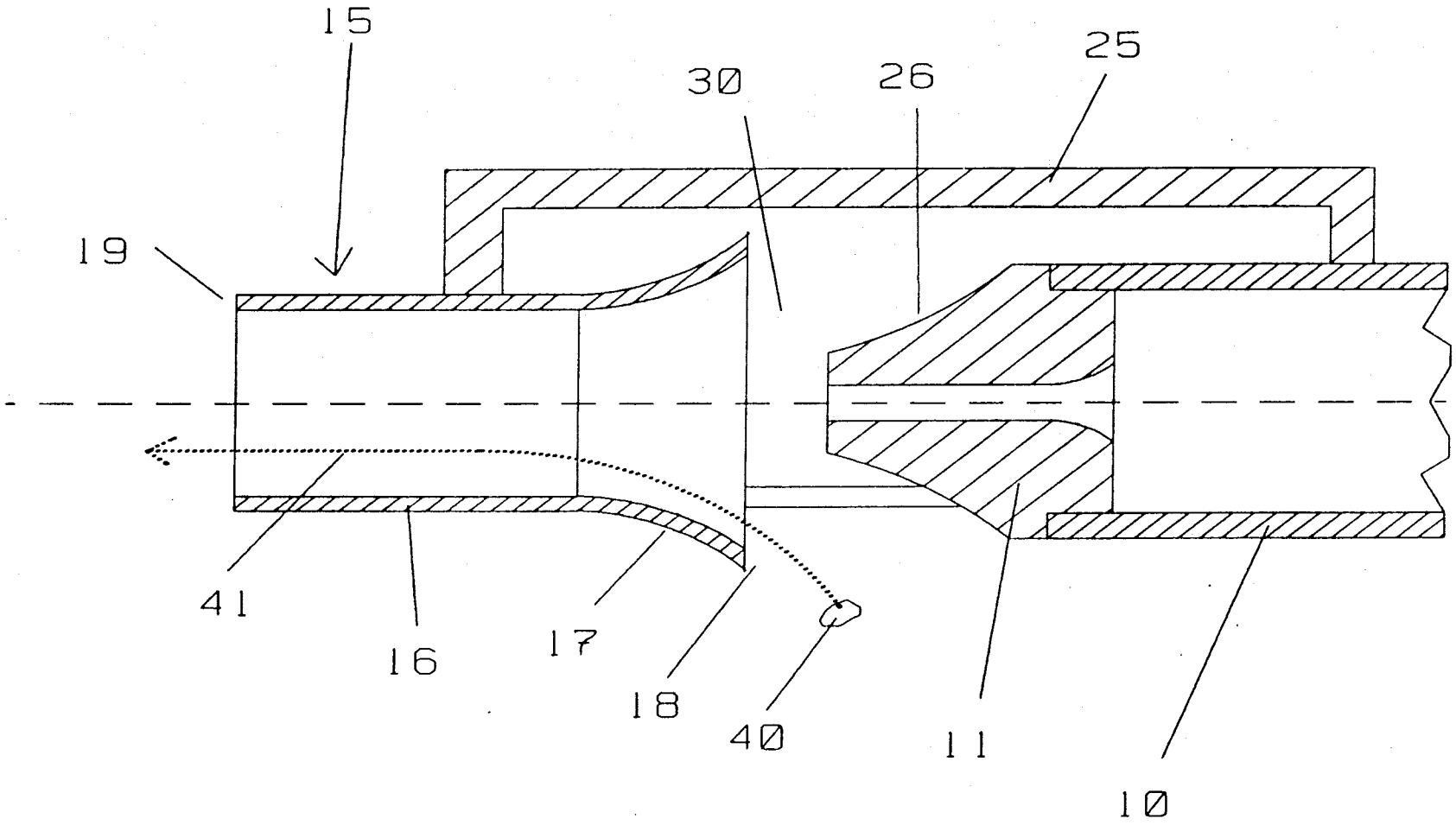
FIG. 7 is a schematic representation of the fluid flow in the grinding zone of a fluidized bed jet mill with an accelerator tube of the present invention mounted on the compressed gas nozzles of the mill.

The accelerator tube, as illustrated in FIG. 7 achieves this result. An accelerator tube 15 is mounted within grinding chamber 2 adjacent to each compressed gas nozzle 11. The accelerator tube has a cylindrical, straight portion 16 and a converging portion 17. It is formed of a hard, rigid material. As with the impact target, the accelerator tube is subject to abrasion by particles striking the tube. It can be made with ceramic, a ferrous alloy, or a ferrous alloy coated with a ceramic. In a preferred embodiment, it is formed of tungsten carbide or of steel coated with tungsten carbide.

The dimensions of the tube vary with the dimensions of the nozzle and the mill. In the illustrated embodiment the accelerator tube is sized for use in an Alpine model AFG 100 mill, which has three nozzles in which the inside diameter is approximately 4 mm and in which the outer diameter of nozzle holder 10 is approximately 1.5". In this embodiment, the straight portion 16 has a length of 1.25" and an inside diameter of 1.25". The converging portion has a length of 0.5" and an inside diameter at the larger end 18 of 2.0".

The tube is mounted adjacent a nozzle by three equally spaced support brackets 25 (only one of which is illustrated). The brackets are shaped to present a minimal cross-section to the fluid flow into the end 18 of the tube closer to the nozzle. The bracket is attached to the straight portion of the tube at one end and to the nozzle holder at the other end. The bracket should be sufficiently rigid to prevent the tube from moving during operation of the mill.

The end of the nozzle is configured with a concave surface 26 roughly corresponding to the curvature of converging portion 17. This provides a smooth, contiguous boundary for the annular opening 30 between the nozzle and the accelerator tube. Particles, such as particle 40, from the fluidized bed enter the accelerator tube through the opening, are accelerated by the discharge jet, and are discharged at the end 19 of the straight portion 16 of the tube into the grinding zone, following a path such as that shown in FIG. 7 as 41.

The location of the end 18 of the tube relative to the end of the nozzle 11 may vary. In a preferred embodiment, the distance is approximately three nozzle diameters. However, the end 18 may be farther from the nozzle or may overlap it. The distance of the end 19 from the central axis of the grinding chamber may also vary, but in a preferred embodiment the distance is approximately equal to the distance between the nozzle end surface and the central axis in a mill that does not use the accelerator tube. This relationship is the same whether or not the central target impact target of the invention is used (i.e., if the target is used, the distance from the end of the tube to the target surface is approximately 20 times the nozzle inside diameter, and if no target is used, the distance from the end of the tube to the central axis is approximately 20 nozzle diameters).

The operation of a fluidized bed jet mill incorporating the throughput efficiency enhancements described above is as follows. In steady state operation (i.e., once the fluidized bed has been established with its circulating load), feed material is continuously introduced into grinding chamber 2 via feed inlet 5. Pressurized air from compressed gas manifold 9 is discharged through nozzles 11 into the grinding zone 2A. The discharge jets from the nozzles fluidize and circulate the feed material in the fluidized bed. If the central impact target 13 of the invention is employed, the particles impinge upon the surface of the target and are fractured upon impact. Accelerated particles may also be fractured by striking other particles within the grinding zone.

A steady mean air flow is conducted from the fluidized bed out the product outlet 6 via the classifier rotor 7. This mean air flow carries fractured particles from the grinding zone to the classifier zone, upwardly and generally along the central axis of the grinding chamber into the classifier rotor by aerodynamic drag forces on the particles. The finer particles can pass through the vanes on the rotor, while the centrifugal force on the larger particles is greater than the aerodynamic drag from the mean air flow and they are rejected from the classifier rotor. The rejected particles flow generally along the peripheral wall 3 of the grinding chamber down to the fluidized bed, where they are recirculated, eventually being accelerated again into the target or other particles.

If the accelerator tube of the invention is employed in the mill, particles circulating in the fluidized bed near the nozzle holders 10 are drawn into the accelerator tubes 15 through annular openings 30 between the nozzle end surfaces 26 and the converging portion 17 of the accelerator tube. The particles are accelerated in the tube and discharged out the ends 19 into the grinding region, where they impinge upon the impact target or other particles.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. A fluidized bed jet mill for grinding particulate material comprising:

A. a grinding chamber having a peripheral wall, a base, and a central axis;

B. a convexly arcuate impact target mounted within said grinding chamber and centered on said central axis of said grinding chamber; and C. a plurality of sources of high velocity gas, said gas sources being mounted in said grinding chamber on said peripheral wall, arrayed symmetrically about said central axis, and oriented to direct high velocity gas along an axis intersecting said central axis within said impact target, each of said sources of high velocity gas comprises a nozzle having an internal diameter;

said impact target has a maximum periphery in a plane perpendicular to said central axis, said maximum periphery being between 3 and 6 times said internal diameter of said nozzle; and the minimum distance between said impact target and any of said nozzles is approximately 20 times said internal diameter of said nozzle.

2. The fluidized bed jet mill of claim 1 wherein said impact target is generally cylindrical and concentric with said central axis.

3. The fluidized bed jet mill of claim 1 wherein said impact target is generally spherical.

4. The fluidized bed jet mill of claim 3 further comprising a mounting member having a first end a second end, said first end being attached to said base of said chamber and said second end being attached to said impact target.

5. The fluidized bed jet mill of claim 3 wherein said impact target is formed of steel.

6. The fluidized bed jet mill of claim 5 further comprising a coating of abrasion-resistant material applied to said impact target.

7. The fluidized bed jet mill of claim 1 wherein each of said sources of high velocity gas comprises:

a. a nozzle holder having a central axis and an outside diameter;

b. a nozzle mounted in one end of said nozzle holder oriented toward said impact target and having an internal diameter; and c. an annular accelerator tube mounted concentrically about said nozzle holder and having a first end proximal to said nozzle and a second end distal from said nozzle, each of said first end and said second end having an internal diameter, said internal diameter of said first end being larger than said internal diameter of said second end and being larger than the external diameter of said nozzle holder, said accelerator tube and said nozzle holder defining an annular opening therebetween through which particulate material in said grinding chamber can enter and be entrained with a flow of gas from said nozzle, accelerated within said accelerator tube by the gas, and discharged toward said impact target.

8. A fluidized bed jet mill for grinding particulate material comprising:

a. a grinding chamber having a peripheral wall, a base, and a central axis;

b. a plurality of sources of high velocity gas, said gas sources being mounted within said grinding chamber on said peripheral wall, arrayed symmetrically about said central axis, and oriented to direct high velocity gas along an axis intersecting said central axis, each of said gas sources comprising:

i. a nozzle holder having a central axis and an outside diameter; and ii. a nozzle mounted in one end of said nozzle holder oriented toward said central axis of said grinding chamber and having an internal diameter; and c. an annular accelerator tube mounted concentrically about said nozzle holder and having a first end proximal to said nozzle and a second end distal from said nozzle, each of said first end and said second end having an internal diameter, said internal diameter of said first end being larger than said internal diameter of said second end and being larger than the external diameter of said nozzle holder, said accelerator tube and said nozzle holder defining an annular opening therebetween through which particulate material in said grinding chamber can enter and be entrained with a flow of gas from said nozzle and accelerated within said accelerator tube and discharged toward said central axis of said grinding chamber;

said accelerator tube comprises a cylindrical outlet portion distal from said nozzle and a converging portion proximal to said nozzle.

9. The fluidized bed jet mill of claim 8 wherein said converging portion of said accelerator tube is shaped as a body of rotation formed by rotating an arc convex to said axis of said nozzle, said converging portion having an internal diameter at its distal end equal to the said internal diameter of said cylindrical portion.

10. The fluidized bed jet mill of claim 9 wherein said accelerator tube is formed of a ferrous alloy coated with an abrasion-resistant ceramic material.

11. A fluidized bed jet mill for grinding electrostatographic developer particles comprising:

a. a grinding chamber having a peripheral wall, a base, and a central axis;

b. a generally spherical impact target mounted within said grinding chamber and centered on said central axis of said grinding chamber; and c. a plurality of sources of high velocity gas, said gas sources being mounted in said grinding chamber on said peripheral wall, arrayed symmetrically about said central axis, and oriented to direct high velocity gas along an axis intersecting said central axis within said impact target, each of said gas sources comprising a nozzle haing an internal diamter, said impact target having a maximum periphery in a plane perpendicular to said central axis, said maximum periphery being between 3 and 6 times said internal diameter of said nozzle.

12. A fluidized bed jet mill for grinding electrostatographic toner particles comprising:

a. a grinding chamber having a peripheral wall, a base, and a central axis;

b. a generally spherical impact target mounted within said grinding chamber and centered on said central axis of said grinding chamber; and c. a plurality of sources of high velocity gas, said gas sources being mounted in said grinding chamber on said peripheral wall, arrayed symmetrically about said central axis, and oriented to direct high velocity gas along an axis intersecting said central axis within said impact target, each of said gas sources comprising a nozzle haing an internal diamter, said impact target having a maximum periphery in a plane perpendicular to said central axis, said maximum periphery being between 3 and 6 times said internal diameter of said nozzle.

13. A method for grinding particles of electrostatographic developer material comprising the steps of:

a. introducing unground particles of electrostatographic developer material into a grinding chamber of a fluidized bed jet mill;

b. injecting high velocity gas from a plurality of sources of high velocity gas;

c. forming a fluidized bed of said unground particles;

d. accelerating a portion of said particles with said high velocity gas;

e. fracturing said portion of said particles into smaller particles by projecting them against a rigid, convexly arcuate body mounted within said grinding chamber;

f. separating from said unground particles and said smaller particles a portion of said smaller particles smaller than a selected size;

g. discharging said portion of said smaller particles from said grinding chamber; and h. continuing to grind the remainder of said smaller particles and said unground particles.

14. The method of claim 13 wherein said rigid, convexly arcuate body is generally spherical and is formed of a ferrous alloy coated with an abrasion resistant ceramic material.

15. The method of claim 14 wherein said unground electrostatographic developer material particles have a mean diameter of approximately 700 μm.

16. The method of claim 15 wherein said electrostatographic developer material is a single component toner comprising approximately equal proportions of magnetite and a binder resin.

17. The method of claim 16 wherein said binder resin has a broadly distributed molecular weight centered about approximately 60,000.

18. The method of claim 13 wherein said developer material comprises a resin and a pigment.

19. The method of claim 18 wherein said pigment is a magnetite.

20. A method for grinding particles of electrostatographic developer material comprising the steps of:

D. introducing unground particles of electrostatographic developer material into a grinding chamber of a fluidized bed jet mill;

E. injecting high velocity gas from a plurality of sources of high velocity gas attached to injecting nozzles;

F. forming a fluidized bed of said unground particles;

G. accelerating a portion of said particles with said high velocity gas;

H. fracturing said portion of said particles into smaller particles by projecting them against a rigid, curved body mounted within said grinding chamber, said rigid, curved body having a diameter D which substantially conforms to the equation:

$$D=(1+2\cdot X\cdot\tan(\alpha/2))\cdot d.$$

wherein:

X = distance from said nozzle to said surface of the rigid, curved body, $\alpha$ = included angle of said portion of said particles, and d = internal diameter of said nozzle;

I. separating from said unground particles and said smaller particles a portion of said smaller particles smaller than a selected size;

J. discharging said portion of said smaller particles from said grinding chamber; and K. continuing to grind the remainder of said smaller particles and said unground particles.

21. The method of claim 20, wherein:

the distance between the surface of said rigid, curved body and said nozzle is between 10·d and 30·d.

22. The method of claim 20, wherein:

said rigid, curved body is a sphere.

23. The method of claim 20, wherein:

said rigid, curved body is a cylinder, the length of said cylinder being equal to its diameter.

* * * * *

UNITED STATES PATENT AND TRADEMARK OFFICE

CERTIFICATE OF CORRECTION

PATENT NO. : 5,133,504

DATED : July 28, 1992

INVENTOR(S) : Lewis S. Smith, et al

It is certified that error appears in the above-indentified patent and that said Letters Patent is hereby corrected as shown below:

| Column | Line | |
|---|---|---|
| 2 | 30 | Before "that" insert --so--. |
| 3 | 24 | After "is" insert --,--. |
| 5 | 9 | Change "abrasionresistant" to --abrasion-resistant--. |
| 6 | 13 | Change "an" to --a--. |
| 8 | 38 | After "modifications" insert --and variations--. |
| 9 | 2 | After "end" insert --and--. |
| 10 | 21 | Change "haing" to --having--; change "diamter" to --diameter--. |
| 10 | 39 | Change "haing" to --having--; change "diamter" to --diameter--. |

Signed and Sealed this

Eighth Day of February, 1994

Bruce Lehman

*Attest:*

BRUCE LEHMAN

*Attesting Officer*

*Commissioner of Patents and Trademarks*